United States Patent [19]

Vladikovic

[11] Patent Number: 4,831,797

[45] Date of Patent: May 23, 1989

[54] CONCRETE FORMING STRUCTURE WITH A-FRAME

[75] Inventor: Predrag Vladikovic, Vancouver, Canada

[73] Assignee: Hy-Rise Scaffolding Ltd., Vancouver, Canada

[21] Appl. No.: 165,415

[22] Filed: Feb. 29, 1988

Related U.S. Application Data

[63] Continuation of Ser. No. 838,323, Mar. 10, 1986, abandoned.

[51] Int. Cl.[4] ..... E04C 3/02; F16D 1/12

[52] U.S. Cl. ..... 52/126.6; 52/693; 49/18; 49/28

[58] Field of Search ..... 52/690, 693, 126.7, 52/126.1; 249/28, 210, 18; 248/357

[56] References Cited

U.S. PATENT DOCUMENTS

| | | | |
|---|---|---|---|
| 3,787,020 | 1/1974 | Avery | 249/18 |
| 3,899,152 | 8/1975 | Avery | 249/18 |
| 3,917,214 | 11/1975 | Ratcliff | 249/18 |
| 3,966,164 | 6/1976 | Dashew | 249/18 |
| 3,977,536 | 8/1976 | Moore | 249/18 |
| 4,036,466 | 7/1977 | Van Meter | 249/18 |
| 4,102,108 | 7/1978 | Cody | 52/693 |
| 4,148,852 | 4/1979 | Dashew | 249/18 |
| 4,492,358 | 1/1985 | Manderla | 249/18 |
| 4,546,581 | 10/1985 | Gustafson | 52/126.6 |
| 4,586,310 | 5/1986 | Baril | 52/693 |

FOREIGN PATENT DOCUMENTS

| | | | |
|---|---|---|---|
| 2330824 | 6/1977 | France | 52/693 |

OTHER PUBLICATIONS

Safeway Publication–Flying Forms published 1968, Form No.-2-117.

*Primary Examiner*—John E. Murtagh

*Attorney, Agent, or Firm*—Bull, Housser & Tupper

[57] ABSTRACT

A concrete forming structure. A pair of first and second chord members are positioned generally parallel and spaced a distance apart. Beam members extend between the pair of chord members. A plurality of rigid web members are mounted between the first and second chord members and are generally movable parallel with and relative to the chord members.

10 Claims, 3 Drawing Sheets

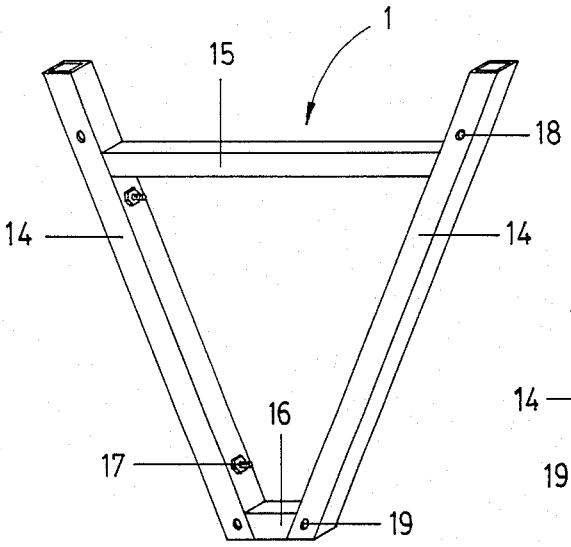
FIG. 3
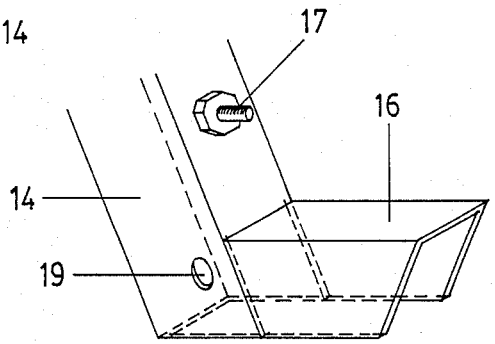
FIG. 4
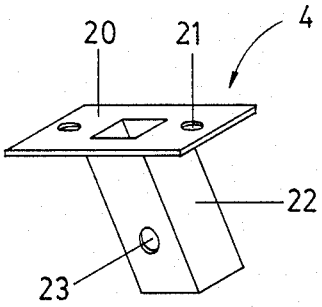
FIG. 5
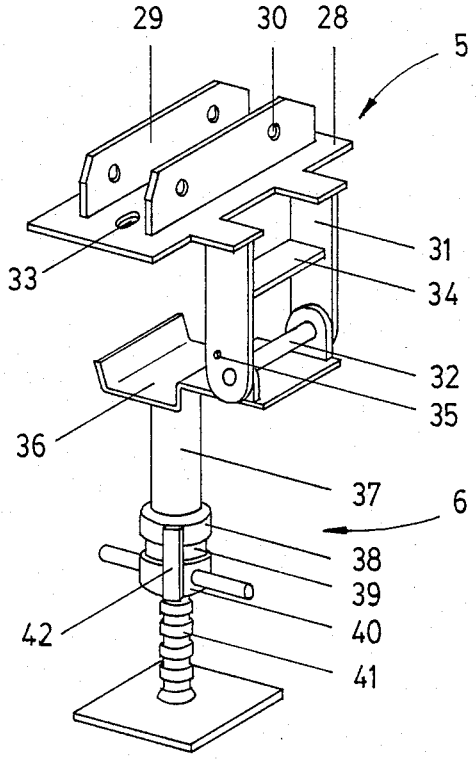
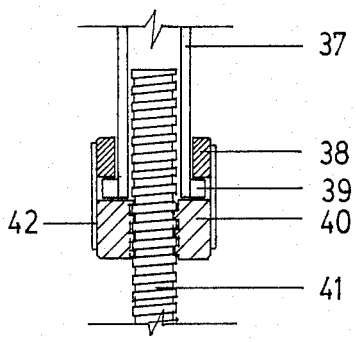
FIG. 7
FIG. 6

CONCRETE FORMING STRUCTURE WITH A-FRAME

INTRODUCTION

This is a continuation of application Ser. No. 838,323 filed Mar. 10, 1986 now abandoned.

This invention relates to an improved fly-form table, which table is particularly used in the construction of concrete forming structures.

BACKGROUND OF THE INVENTION

Flying shoring forms are well known for supporting cast in place concrete used for large and multiple slab areas, wide bays and multi-level constructions as described in the Canadian Pat. No. 941,138. The common name of such forms used for slab support is the fly-form table. Such forms are reusable and their name is derived from their method of use. After pouring the concrete and after the concrete has hardened, the table forms are lowered from the concrete floor which was poured on them and then rolled outwardly from the building. They are subsequently lifted by a crane, as if they were flying, and transported to the next slab area.

BRIEF SUMMARY OF THE INVENTION

Several different types of fly-form tables are presently used to support successively formed concrete slabs. However, there are inherent disadvantages present with such forms. Present forms are constructed, clearly, to withstand the greatest weight of concrete that may be placed on each form. While the structure of such fly-forms is clearly satisfactory if the particular design weight of concrete is used they become unnecessarily heavy when they are used to support a concrete slab that may be less than the heavier designed load. This additional and unnecessary weight requires heavier duty cranes than may be necessary and, therefore, they may incur unnecessary expensive costs.

Yet a further disadvantage with existing fly-forms is the technique that is used to set up the forms in order to pour the concrete slabs. The fly-form is positioned beneath the slab to be formed and, thereafter, it is raised or lowered to the desired height. After the cement has hardened, the form is lowered, removed from its position and set up again for subsequent pouring. In raising and lowering the fly-form, jacks are used beneath the truss chords which, typically, are positioned beneath the form in a plurality of locations and then individually raised to raise the fly-form. Because the jacks are separate from the fly-form, additional transporting trips may be necessary and, of course, the many jacks may be misplaced or lost.

Yet a further disadvantage with existing fly-forms is the time-consuming nature of assembly. Truss and web members, are used in the construction of such forms. The web members are fitted to the top and bottom truss members in a permanent and rigid relationship. Because each web member is permanently connected to the truss members the assembly requires the connection of the web members to the truss members with screws and/or bolts. This is unnecessarily time-consuming and, if the form is desired to be broken down or stored, the removal of the nuts and/or screws becomes necessary which, again, is inefficient.

SUMMARY OF THE INVENTION

According to one aspect of the invention, there is disclosed a concrete forming structure comprising a plurality of substantially rigid A-frame web members and first and second chord members, said A-frame members being mounted between said first and second chord members.

According to a further aspect of the invention, there is disclosed a clamp for a concrete forming structure having chord and web members, said clamp joining said truss and A-frame web members, said clamp having a jack supporting means structurally independent from said chord member.

According to yet a further aspect of the invention, there is disclosed a screw jack comprising a tube, a threaded bar adapted for height adjustment, a rotatable ring, a nut movably engageable with said threaded bar, a nut connected to said rotatable ring and a fixed ring between said nut and said rotatable ring, said nut being operable to cause advance or withdrawal of said threaded bar relative to said tube.

According to yet a further aspect of the invention, there is disclosed an edge clamp for the deck surface of a concrete forming structure having a beam member and a wooden end member adjacent to the end of said beam member, said clamp compising a first section movably connectable to said beam member and a second section generally parallel to said first section and positioned a distance therefrom, said second section being operable to enter said wooden end member and to move with said first section relative to said beam member.

BRIEF DESCRIPTION OF THE SEVERAL VIEWS OF THE DRAWINGS

A specific embodiment of the invention will now be described, by way of example only, with the use of drawings in which:

FIG. 3 is an isometric the A-frame shaped web member according to the invention;

FIG. 4 is an isometric, enlarged view of the bottom part of the A-frame in FIG. 3;

FIG. 5 illustrates a top clamp used for connecting the A-frame to the top truss chord;

FIG. 6 illustrates the hinged bottom clamp and its connected screw jack, the clamp being used to connect the A-frame web member and the lower truss member;

FIG. 7 is an enlarged sectional view taken through the screw jack of FIG. 6;

DESCRIPTION OF SPECIFIC EMBODIMENT

Figure 1:
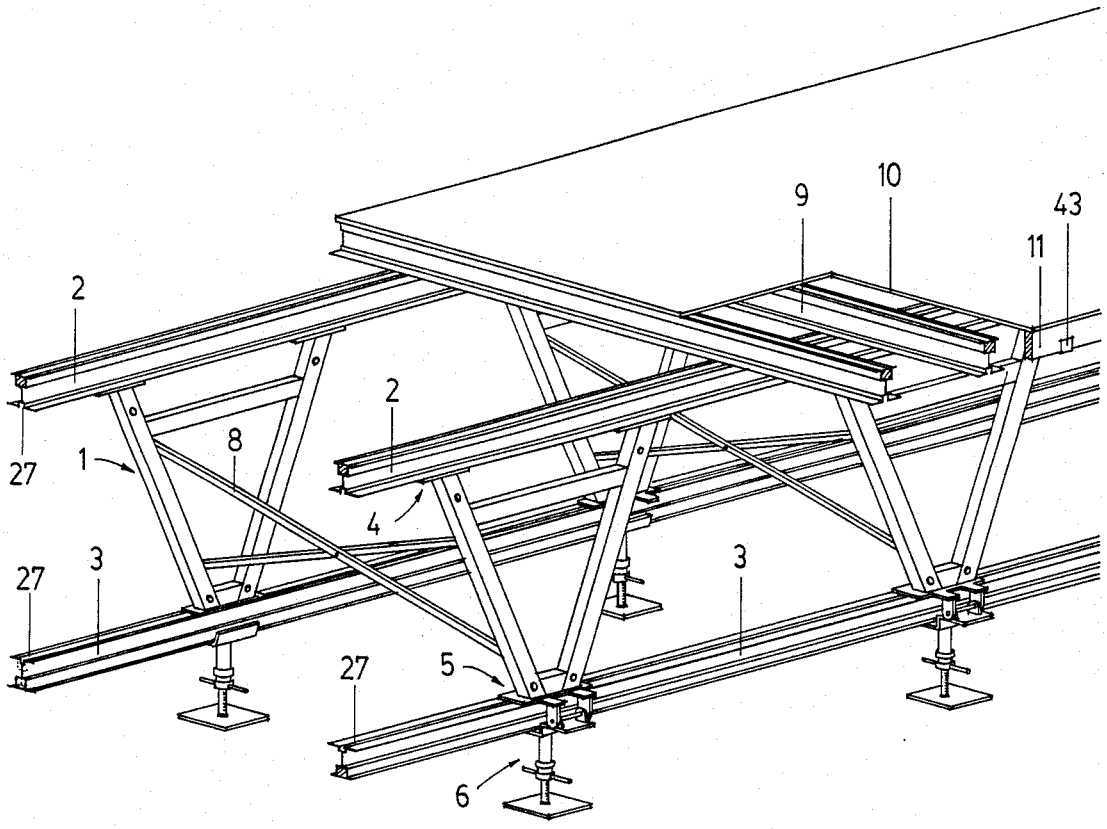
FIG. 1 is a partial isometric view of the fly-form table according to the invention.

Referring now to the drawings, an A-frame web members indicated generally at 1 in FIGS. 1 and 3 is substantially rigid and comprises two angled, hollow tubes 14 and two further identical hollow tubes 15,16 extending therebetween. Tube 14 includes two pins 17 used for attachment to cross brace 8. The pins 17 are machine bolts which are attached to the A-frame member 1 through a hole formed in the tubes 14 with the heads inside the tube 14 which are secured with a nut on the outside of the tube 14. Cross brace 8 with holes on each end fits onto the pins 17 as illustrated in FIG. 1 and is secured with a wing nut (not shown).

Holes 18,19 are provided in tubes 14 which connect the top clamping member illustrated generally at 4 in FIG. 5 and the bottom clamp illustrated generally at 5 in FIG. 6 to the A-frame members of FIG. 1.

Figure 9:
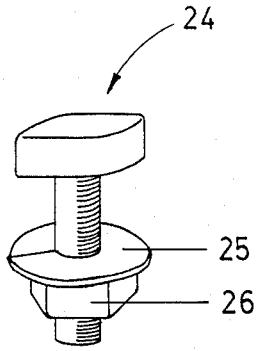
FIG. 9 is an enlarged view of lock bolt illustrated in FIG. 10.

The top clamp 4 comprises a hollow tube 22 and a plate 20 of the same width as the wider flange of a standard scaffolding aluminum top chord 2 in the truss assembly. Slotted holes 21 are located on the center line of the plate 20 and have a radius to match the width of the channel 27 first and second aluminum chord members 2,3, respectively. The elliptical head of lock bolt 24 (FIG. 9), is inserted underneath the plate 20, through the hole 21 and into the channel 27 of the top chord 2. It is then turned a quarter turn inside. The elliptical heads thereby lock in the channel 27 and secure the bolt 24 from falling out of the channel 27. The nut 26, on lock washer 25 tightens the plate 20, and secures the top clamp 4 to the top chord 2.

The hollow tube 22 is welded at an angle to the plate 20 and is placed within the hollow tube 14 of the A-frame 1 as illustrated in FIG. 1. The outside dimension of the tube 22 is slightly smaller than the inside dimension of the tube 14 so as to allow insertion and placement. Hex head bolts (FIG. 10) are inserted through holes 18,23 are tightened with their nuts and washers to prevent the clamp 4 of the tube 14 from sliding out.

Figure 2:
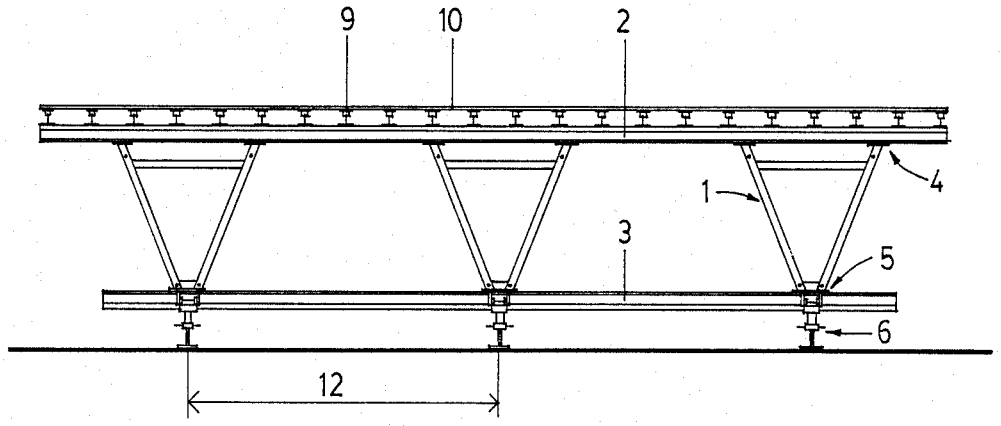
FIG. 2 is a side view of the fly-form table of FIG. 1.

The bottom clamp indicated generally at 5 in FIG. 6, connects from FIG. 1, between the A-frame member 1, the bottom chord 3 (FIG. 2) and the screw jack illustrated generally at 6. The bottom clamp 5 comprises a plate 28 having the same width as the wider flange of the standard scaffold aluminum bottom chord 3 and two flat bars 29 is used to connect the A-frame member 1. Two further supporting flat bars 31 are independent of the chord member 3 and are used as a jack supporting means and to hold the hinge pin 32. Slotted holes 33 are provided on the center line of the plate 28 and their width matches the width of the channel 27 (FIG. 1) in the bottom chord 3. A lock bolt 24 (FIG. 9) with an elliptical head is placed from the top through the hole 33 of the plate 28 into the channel 27 of the bottom chord member 3. It is then turned a quarter turn. With the nut 26 over the lock washer 25, the plate 28 and clamp 5 are secured to the bottom chord 3. The purpose of the flat bars 31 is to provide a connection between the A-frame member 1 and the bottom clamp 5. The outside dimension between the flat bars 29 is slightly smaller than the inside dimension of the tubes 14 and 16 and, with reference to FIG. 4, the tubes 14 and 16 are without a bottom wall. When the A-frame member 1 and the bottom clamp 5 are assembled, the holes 19 and 30 match, and a hex head bolt with nut and washer extending therethrough provides a strong connection. The flat supporting bars 31 provide the connection between the screw jack 6 and the bottom clamp 5. The flat supporting bars 31 are welded to plate 28 and have a stiffener 34 extending therebetween. A pin 32 extending through the bottom part of the supporting bars 31 allows rotation of the screw jack 6 to the side as explained hereafter.

The screw jack 6 includes, a top plate 36 hingedly secured to the members 31 at the hinge consisting of a hinge pin 32 and hinge flanges. A tube or pipe 37 is welded to the plate 36 and a fixed ring 39 is welded to the lower end of the pipe 37 (FIG. 7) and between the nut 40 and the rotatable ring 38. The nut 40 is connected to the rotatable ring 38 and includes handles for facilitating height adjustment. A threaded bar 41 extends into the nut 40 and pipe 37 as illustrated in FIG. 7. The rotatable ring 38 is secured to nut 40 with flat bars 42. The nut 40 is turned by its handles, and being engagable with the threaded bar 41 to advance or withdraw relative to tube 37. The ring 38 provides support for the treaded bar 41 with the plate 36 and prevents the jack 6 from falling from the structure when it is being transported as in the flying process between pourings.

To prepare for the transportation or flying procedure, the screw jack 6 is swung away from a position beneath the bottom chord 3, and the plate 36 is secured in an upper position with a pin through the hole 35 in the bearing bar 31.

Figure 10:
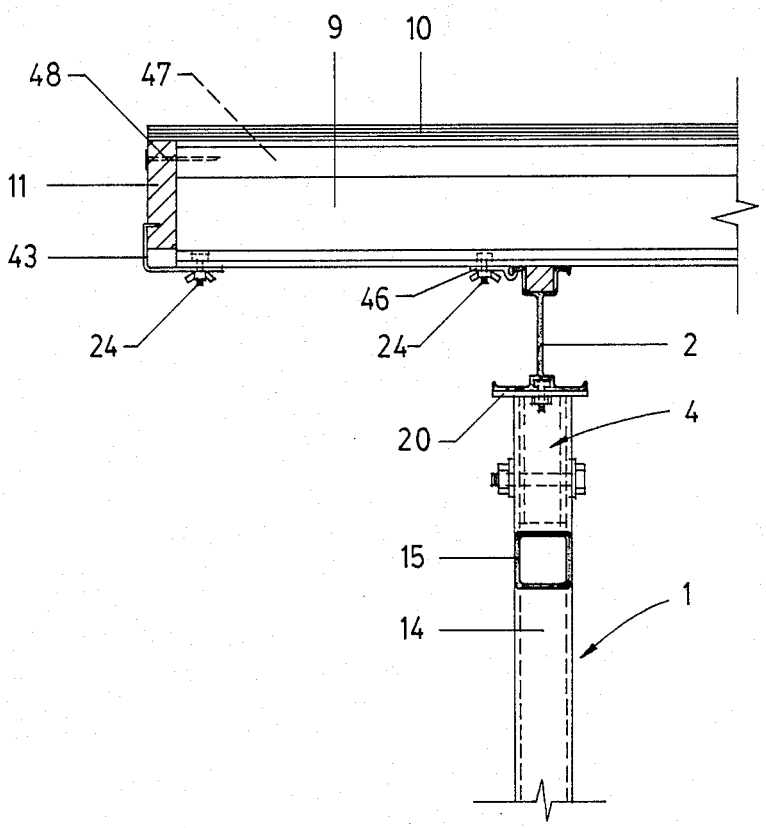
FIG. 10 is a sectional view through the edge of the fly-form table of FIG. 1 illustrating the edge clamp, and the connection between the two truss members; the aluminum beam members and the A-frame web members.

The fly-form table is assembled as follows with reference to FIGS. 1 and 10. The top clamps are fastened with bolts to the A-frame members 1. The top chord member 2 is then placed on the top clamp 4 and fastened with two of the lock bolts 24 (FIG. 9) at each clamp 4. The bottom clamp 5 is attached to the bottom chord member 3 with three of the lock bolts 24 and the A-frame 1 with the top chord 2 already in place is placed on top of the bottom clamp 5 in assembly with the screw jack, 6 and connected with two bolts. A further truss assembled as described is connected with the first truss and they are interconnected with cross braces 8. The deck installation may then be installed on the truss members 2.

The deck consists of common scaffolding aluminum beams 9 used as joists (FIG. 10) having the same section as the top and the bottom truss chords 2,3. These joints 9 are covered with plywood 10. The beams 9 and the truss members 2 are fastened with commonly used aluminum beam clips 46 (FIG. 10) and lock bolts 24 in a conventional manner.

Figure 8:
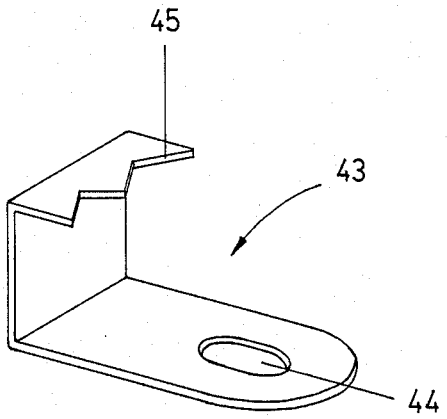
FIG. 8 is the edge clamp attachment means used for the wood strip edges of the fly-form table of FIG. 10.

Previously, a 2×6 wood strip means 11 was fastened to the edge of the deck only with nails 48 which extended into the 2×2 wood strip 47 in the aluminum beam 9. A disadvantage of this fastening is that the bottom part of the 2×6 wood strip means 11 is very unstable and often must be adjusted and repaired during the use of the system. Due to the movement of the nails in the 2×2 strip 47, the wood splits and, after a few uses, the strip 11 must be changed. The edge clamp 43 (FIG. 8) has a first section moveably connectable to the beam member 9 and allows a firm connection to be achieved between the 2×6 wood strip 11 and a aluminum beam 9. The edge clamp 43 is fastened to the aluminum beam 9 with the lock bolt 24 whose eliptical head goes into the channel 27 of the beam 9 through the oval hole 44, and is tightened with a wing nut. One portion of the edge clamp 45 (FIG. 8), is forced into the wood 11. The assembly is achieved as follows. The 2×6 wood strip 11 is nailed to the 2×2 wood strip 47 in aluminum beams 9. Clamp 43 is then lightly tightened to the aluminum beam 9 with the lock bolt 24 and the second section 45 of the clamp 43 which is generally parallel to the first section 45 and spaced a distance therefrom enters the wood strip 11 by being implanted with a hammer while it moves with the first section relative to the beam maker. The lock bolt 24 is then tightened.

The flexibility and strength of the A-truss is changed by varying the spacing 12 (FIG. 2) between the supporting A-frame members 1 which are moveable lengthwise along the first and second chort members 2,3, because of the slidable connections, relative to the loading which varies depending on the (concrete thickness). The fly-form table with the A-trusses is preferably made from extruded aluminum sections and it is considerably lighter than conventional fly-form tables. The savings in weight and the number of truss elements can cause a significant reduction in assembly and deassembly time.

While a specific embodiment of the invention has been described, such description should be considered as illustrative only and not as limiting the scope of the invention as defined in accordance with the accompanying claims.

I claim:

1. A concrete forming structure comprising:

(a) first and second spaced apart parallel chord members, (b) a plurality of substantially rigid web members spaced along and extending between the chord members, the web members having first and second ends which are releasably connected with fastening means to the first and second chord members respectively to permit longitudinal adjustment of the positions of the web members along the chord members by adjustment of the fastening means only, with the web members remaining intact, the spacing between the first and second ends of the web members being essentially constant at any position of said web members along said chord members, the first end of the web spanning a length of the first chord member which is longer than a length of the second chord member spanned by the second end of the web, so as to concentrate load from the first end of the web to the second end of the web, and (c) jack means connected to and movable with at least one of the web members and extending downwardly from said second chord member to support the concentrated load from the first end of the web, positions of the jack means being adjustable with the web members longitudinally of the second chord member.

2. The concrete forming structure according to claim 1 wherein said web members between said first and second chord members substantially resemble the inverted letter A.

3. The concrete forming structure according to claim 2 wherein each of said letters A has a respective apex connected to respective jack means.

4. The concrete forming structure according to claim 3 wherein each web member is slidably connected with said first and second chord members.

5. The concrete forming structure according to claim 1 and further comprising a connecting member between said web member and said first chord member, said connecting member comprising a clamp between said first chord member and said web member.

6. The concrete forming structure according to claim 1 wherein:

the first and second ends of the web members are fitted between oppositely facing surfaces of the chord members to reduce shear loads on the releasable fasteners connecting the web members and the chord members together.

7. A concrete forming structure according to claim 1 wherein the jack means is hingedly connected to and is movable with each of said web members.

8. The structure according to claim 7 further including:

a bottom clamp assembly provided adjacent to the second end of the web member so as to releasably connect the web member to the second chord member, wherein the jack means is connected to the bottom clamp assembly.

9. The concrete forming structure according to claim 8 in which the bottom clamp assembly comprises:

a connection extending between the second end of the web member and the jack means when in an operative lowered position, the connection providing a clearance between an upper portion of the jack means and the second end of the web member to receive the second chord member between the jack means and the web member so as to transfer load from the first chord member, through the web member and the second chord member, onto the jack means.

10. The concrete forming structure according to claim 9 wherein:

the jack means is hinged to the connection extending from the web member to permit the jack to be swung from a lowered operative position to a raised inoperative position.

* * * * *